US007201171B2

(12) United States Patent
Sthair

(10) Patent No.: US 7,201,171 B2
(45) Date of Patent: Apr. 10, 2007

(54) SEAMLESS HAIR EXTENSION SYSTEM AND METHOD OF USE

(75) Inventor: Okyo Sthair, Tamarac, FL (US)

(73) Assignee: Aderans Co., Ltd., Tokyo (JP)

( * ) Notice: Subject to any disclaimer, the term of this patent is extended or adjusted under 35 U.S.C. 154(b) by 150 days.

(21) Appl. No.: 10/954,517

(22) Filed: Sep. 30, 2004

(65) Prior Publication Data

US 2005/0092342 A1 May 5, 2005

(51) Int. Cl.
*A41G 3/00* (2006.01)

(52) U.S. Cl. ..... 132/201; 132/53

(58) Field of Classification Search ..... 132/201, 132/53, 54

See application file for complete search history.

(56) References Cited

U.S. PATENT DOCUMENTS 3,710,452 A * 1/1973 Harnrick ..... 34/95
3,980,092 A * 9/1976 Garufi ..... 132/53
5,072,745 A 12/1991 Cheh
5,107,867 A 4/1992 Barrington
5,575,298 A * 11/1996 Hinton ..... 132/200
5,592,957 A * 1/1997 Gazerro et al. ..... 132/53
5,607,479 A * 3/1997 Jones et al. ..... 128/898
5,868,145 A * 2/1999 Spann ..... 132/201
5,881,737 A * 3/1999 Nelson ..... 132/201
6,012,460 A * 1/2000 Kikuchi ..... 132/53
6,135,122 A * 10/2000 Campbell et al. ..... 132/201
6,170,491 B1 * 1/2001 Maekawa ..... 132/201
6,405,736 B2 6/2002 Townsend
6,935,348 B2 * 8/2005 Gold ..... 132/53
2001/0037813 A1 * 11/2001 Ra ..... 132/53
2004/0237987 A1 * 12/2004 Gold ..... 132/201

* cited by examiner

*Primary Examiner*—Todd E. Manahan
*Assistant Examiner*—Rachel A. Running
(74) *Attorney, Agent, or Firm*—Wenderoth, Lind & Ponack, L.L.P.

(57) ABSTRACT

The present invention consists of a seamless self-adhesive hair extension and a method of attaching it to a head of a wearer. The seamless self-adhesive hair extension is comprised of a plurality of either natural or synthetic hair strands attached to a base support made of polyurethane which has a rectangular strip of double-sided self-adhesive tape with a removable backing as a fastener. The method consists of separating a user's hair along a part line into an upper portion and a lower portion, wherein the upper portion and lower portion are temporarily swept up and away from the part line. Another double-sided rectangular strip of self-adhesive tape is placed along a lower portion part line approximately ¼" from the scalp onto the user's natural hair, and then alternating ¼" strands of the user's natural hair are withdrawn from the upper portion of hair above the part line such that the strands will be laid upon the double-sided self-adhesive tape. The removable backing is removed from the tape that is attached to the hair extension or ventilated polyurethane strip, thereby exposing the self-adhesive tape; and the self-adhesive hair extension or ventilated polyurethane strip is applied to the other double face tape on the user's head which contains the strands of the user's natural hair.

20 Claims, 7 Drawing Sheets

SEAMLESS HAIR EXTENSION SYSTEM AND METHOD OF USE

BACKGROUND OF THE INVENTION

1. Field of the Invention

The invention is concerned with the field of devices and methods that provide an appearance of longer or thicker hair. More specifically, the invention is concerned with a hair attachment comprised of natural or synthetic hair that is releasably attached directly to hair of a wearer in order to provide the wearer with an appearance of highlighted and or longer and or thicker hair, without causing any tension to the wearer's scalp and or hair.

It is a common desire among many people to acquire hair that is longer and thicker than that which they posses for a variety of reasons, such as self esteem and satisfaction, quickly changing fashion styles, and the like. For example, short hair, which is in fashion for a period of time, may quickly be replaced as current fashion with longer fuller hairstyles. In another example, bangs worn on a forehead may be in fashion for the winter and by the summer this style may be quickly replaced by another style. As hair grows at a rate of approximately less than one inch per month, many people find that it is exceedingly difficult to acquire a contemporary hairstyle in a reasonable time. Even when someone possesses hair of substantial length, the hair may lack thickness or overall volume to achieve a desirable hairstyle. People may also want to add highlights to their hair without having to cause damage to their hair.

Various devices and techniques are available in the prior art and in the marketplace that attempt to satisfy a need and desire for longer and thicker hair. A common well known device is a wig. Although wigs provide a quick and simple means to achieve longer hair, they do not present a fully natural appearance, a condition that leads to their recognition when they are being worn. More recently, a variety of more natural hair enhancement techniques have become popular with a variety of users. These consist of hair weaves, hair extensions, hair braiding and the like, whereby natural or synthetic hair is attached to a scalp of existing hair of a wearer by a variety of techniques in order to provide an appearance of longer, thicker hair without a noticeable artifice of a wig. These techniques and systems, which overcome obvious disadvantage of a wig, also suffer from several drawbacks as they are relatively expensive and time consuming to acquire and frequently discomfort the wearer during application, as well as possibly being difficult to maintain.

2. Description of the Prior Art

Numerous designs, devices, and methods for lengthening and enhancement have been provided in the prior art. Even though these designs may be suitable for specific individual purposes to which they are addressed, they would not be suitable for purposes of the invention as they involve relatively elaborate and time consuming techniques and methods as referenced earlier. These techniques are exemplified by: U.S. Pat. No. 5,072,745, Hair Extension Process, issued to Cheh on Dec. 17, 1991; U.S. Pat. No. 5,107,867, Process for Extending Human Hair, issued to Barrington on Apr. 28, 1999; U.S. Pat. No. 5,868,145, Hair Extension and Thickening process, issued to Spann on Feb. 9, 1999; U.S. Pat. No. 5,881,737, Method of Attaching A Hair Weft To The Hair Of A Wearer, issued to Nelson on Mar. 16, 1999; and U.S. Pat. No. 6,405,736, Method of Using A Self Adhesive Hair Extension, issued to Townsend on Jun. 18, 2002, which discloses a hair attachment device designed to provide an appearance of longer, thicker, and fuller hair. The attachment device consists of a quantity of natural or synthetic human hair that is sewn to a rectangular shaped, self-adhesive tape having a removable back, which is applied to a scalp or hair of a wearer in a releasably engageable manner. While a hair attachment is relatively simple to apply, the self-adhesive tape provides a less than adequate means to secure ends of strands of natural or synthetic hair, which can become prematurely separated from the self-adhesive tape and become unusable in the future.

As such, it may be appreciated that there is a continuing need for a new and improved method and device for providing an appearance of longer and thicker hair in a manner that is relatively simple and inexpensive to achieve. In these respects, the present invention substantially departs from conventional concepts and designs of the prior art, and in so doing provides an apparatus that substantially fulfills this need. Additionally, the aforementioned patents and commercial techniques do not suggest the present inventive combination of component elements arranged and configured as disclosed herein.

The present invention achieves its intended purposes, objects, and advantages through a new, useful and unobvious combination of method steps and component elements, with use of a minimum number of functioning parts, at a reasonable cost to manufacture, and with use of readily available materials.

SUMMARY OF THE INVENTION

The present invention, which will be described in greater detail hereinafter, relates to a field of devices and methods that provide an appearance of longer, thicker or highlighted hair. More specifically, the invention is concerned with a hair attachment comprised of natural or synthetic hair that is releasably attached directly to hair of a wearer to provide the wearer with an appearance of longer, thicker or highlighted hair. The invention overcomes all of the shortcomings listed previously, in addition to providing novel aspects that will be described in detail hereinafter.

Described briefly, according to a typical embodiment, the invention presents a hair attachment device or hair extension that is releasably attached to hair of a wearer in order to provide an appearance of longer, thicker fuller and/or highlighted hair without use of chemicals that will cause damage to the wearer's hair and/or scalp. The hair extension thus allows the wearer to change an appearance of their hair without chemical damage in order to achieve fashion styles that use longer hair, or simply to enhance his/her appearance by achieving particular hair designs heretofore impossible without aid of a hair extension and/or damaging chemicals. The hair extension that is the subject of the instant invention consists of a quantity of natural or synthetic hair strands that are disposed in a parallel relationship and are attached or secured at one end to a flexible strip of polyurethane. The polyurethane securely anchors the hair strands to one end of a double face adhesive tape so that the strands do not become separated from the double face adhesive tape. This ventilated strip of polyurethane is sufficiently flexible to accommodate a shape of the wearer's head. A fastener comprised of a rectangular strip of self-adhesive double-sided tape with a removable backing is attached to the ventilated polyurethane strip in order to provide adhesion necessary to secure the hair extension to hair of the wearer. The hair extension can be applied to the wearer's hair in various quantities and locations thereon as needed to achieve a desired look and appearance. The hair extension may be reused as well by simply wetting the fastener, or double-sided self-adhesive tape on the hair extension, with citrus oil, separating the tape from the strip of polyurethane base support, and discarding the tape. A new rectangular strip of double-sided self-adhesive tape may be reapplied to the strip of polyurethane in order to reuse the hair extension. The strands of hair secured to the ventilated polyurethane strip as referenced earlier can be natural or synthetic and are also available in a variety of textures, colors and lengths.

The invention, therefore, resides not in any one of these features per se, but rather in the particular combination of all of them as herein disclosed. It is distinguished from the prior art in this particular combination of all of its structures for functions specified as follows: can be used on those wearers who have sensitive scalps; for those who just had a face lift performed wanting to disguise a receded hair line surgery has produced; for those wanting to achieve highlighted hair without use of damaging solutions; for those whose crown hair line has receded due to age or other factors; as well as for those wanting a temporary eyebrow lift which is achieved by simply disguising side temples of the hair line which in turn has receded due to age or other factors; or for those who simply desire longer and or thicker hair.

The foregoing has outlined rather broadly the more pertinent and important features of the present invention in order that a detailed description of the invention that follows may be better understood so that the present contribution to the art can be more fully appreciated. Additional features of the invention will be described hereinafter. It should be appreciated by those skilled in the art that conception and the disclosed specific method and structures may be readily utilized as a basis for modifying or designing other structures for obtaining the same purposes of the present invention. It should be realized by those skilled in the art that such equivalent methods and structures do not depart from the spirit and scope of the invention.

In this respect, before explaining at least one embodiment of the invention in detail, it is to be understood that the invention is not limited in its application to details of construction and to arrangements of components set forth in the following description or illustrated in the drawings. The invention is cable of other embodiments, and of being practiced and performed in various ways. Also, it is to be understood that phraseology and terminology employed herein are for a purpose of description and should not be regarded as limiting.

As such, those skilled in the art will appreciate that the conception, upon which this disclosure is based, may readily be utilized as a basis for designing of other structures, methods and systems for obtaining the several purposes of the present invention.

Accordingly, it is an object of the invention to provide an easy to use, comfortable to wear, and no tension caused to a scalp or a wearer's hair, reusable seamless self-adhesive hair extension.

A significant object of the invention is to provide a seamless self-adhesive hair extension that is comprised of a strip of polyurethane that has been ventilated with a quantity of parallel arranged natural or synthetic hair strands attached to one side of a strip of clear double face self-adhesive tape, which is then secured to hair of a wearer by another strip of clear double face self-adhesive tape which will encompass alternating parallel ¼ sections of the wearer's own natural existing hair.

Another very significant object of the invention is to provide a seamless self-adhesive hair extension that provides an appearance of longer, thicker, and/or highlighted hair by overcoming disadvantages of conventional hair enhancing and supplementing devices and techniques, such as wigs, hair weaves and braids, and removable hair extensions and attachments.

A final but very important aspect of the invention is that it is virtually undetectable to the eye or touch, due to the hair being ventilated through a very thin but durable polyurethane layer and or strip, and then attached with a double face self-adhesive tape, thus making it easy to apply to the wearer's crown and or temples, if so desired.

For a better understanding of the invention, its operating advantages and the specific objects attained by its uses, reference should be made to the accompanying drawings and descriptive matter in which they are illustrated as a preferred embodiment of the invention.

The foregoing has outlined some of the more pertinent objects of the invention. These objects should be construed to be merely illustrative of some of more prominent features and applications of the present invention. Accordingly, other objects and a fuller understanding of the invention may be had by referring to the Summary of the Invention and the Detailed Description of the Preferred Embodiment in addition to the scope of the invention illustrated by the accompanying drawings.

BRIEF DESCRIPTION OF THE DRAWINGS

The foregoing and other objects, feature and advantages of the invention will become more fully understood from the following description of a preferred embodiment of the invention as illustrated in the accompanying illustrations in which like reference characters refer to the same parts throughout different views.

DRAWING REFERENCE NUMERALS

10 Seamless Self-Adhesive Hair Extension system
12 Hair Extension Hair Strands
14 Fastener (self-adhesive double-sided tape)
16 Polyurethane Strip Ventilated with Supplemental Hair
18 Attached End of Hair Strands
20 Unattached End of Hair Strands
22 Self-Adhesive Double-Sided Tape
24 Tape Backing
26 Ventilated Hair Strands within the Polyurethane Strip
28 Wearer

30 Part Line of Hair
32 Upper Portion of Hair
34 Lower Portion of Hair
36 Velcro Strip
38 Wearer's Natural Hair Strands
40 Crotchet needle
42 Top View of Seamless Self-Adhesive Hair Extension System

DETAILED DESCRIPTION OF THE PREFERRED EMBODIMENT

Figure 1:
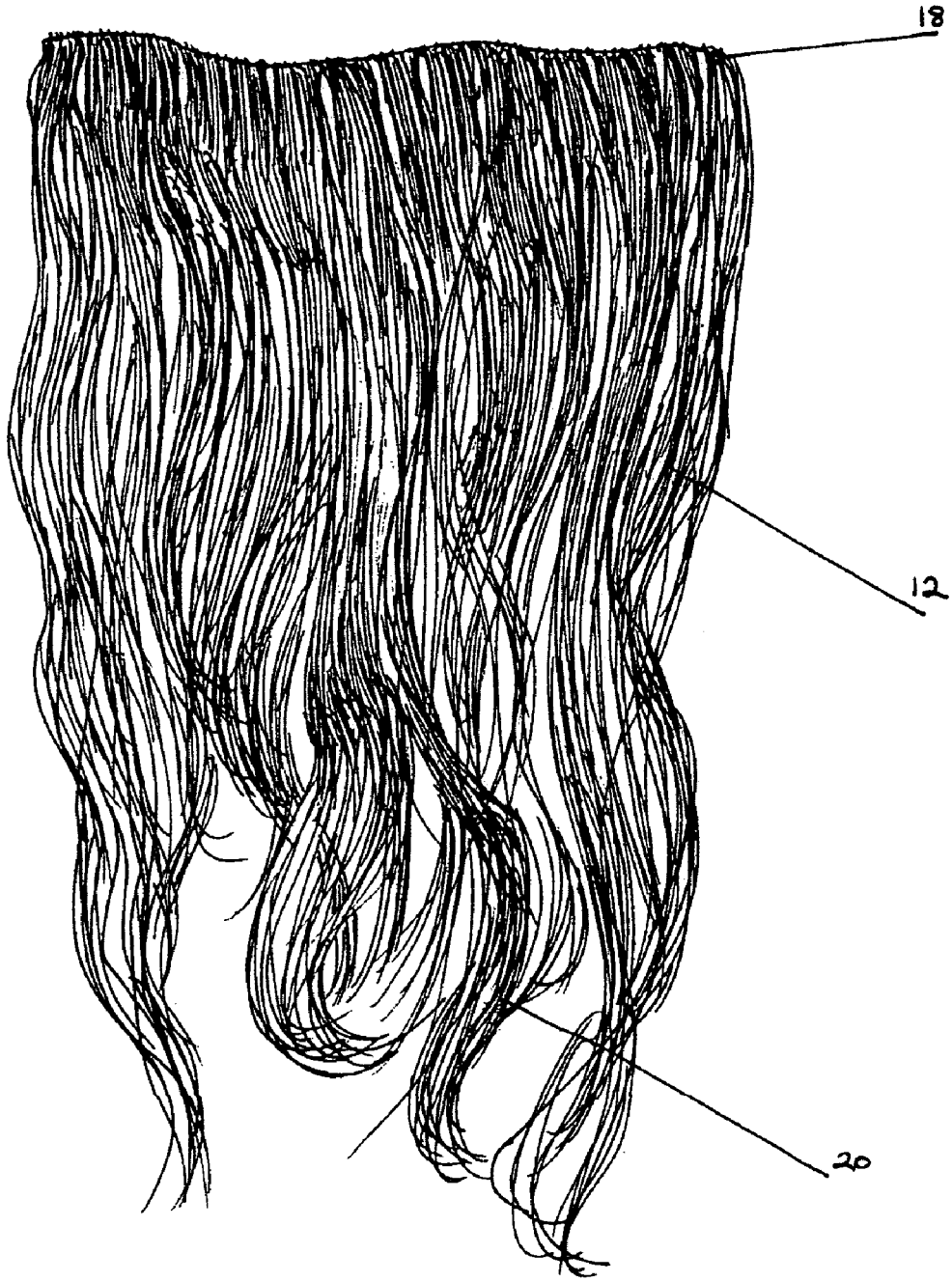
FIG. 1 is an actual view of a seamless self-adhesive hair extension front complete view.

Referring now to illustrations, and in particular to FIG. 1, wherein there is an actual view of a seamless self-adhesive hair extension 10. The hair extension 10 consists of a plurality of supplemental hair strands 12. The hair strands 12 are comprised of natural or synthetic supplemental hair in a variety of lengths, diameters, textures, and colors in order to accommodate desires and needs of a variety of wearers and fashion styles. A quantity of hair strands 12 is arranged generally or typically in a parallel arrangement so the strands 12 are aligned at a first attached end 18 and a second non-attached end 20.

Figure 2:
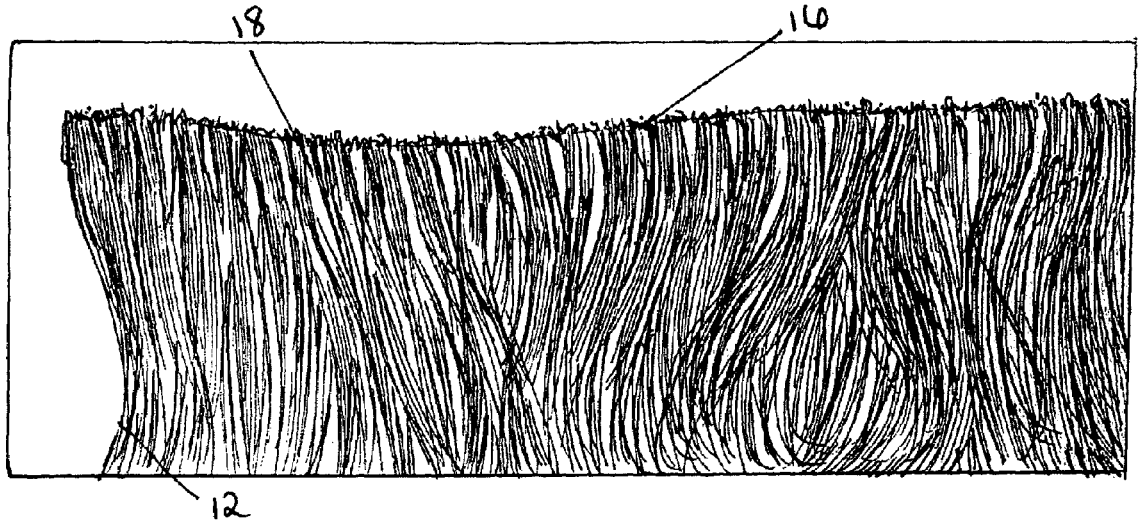
FIG. 2 is an exploded front or face view of a seamless self-adhesive hair extension.

Referring to FIG. 2, there is illustrated an exploded front or face view of a polyurethane strip 16 containing the attached end of the hair strands which are ventilated throughout the polyurethane strip 16.

Figure 3:
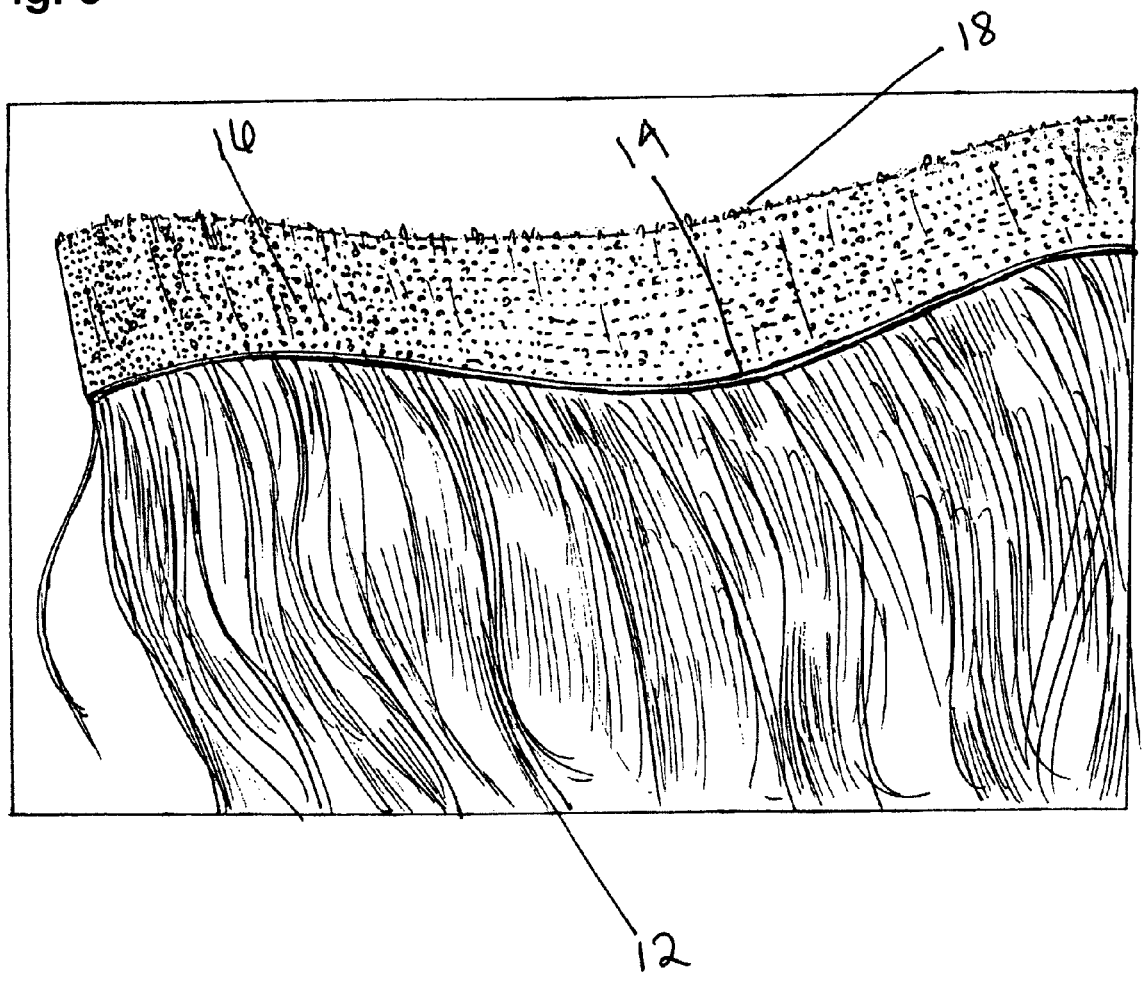
FIG. 3 is an actual view of a seamless self-adhesive hair extension with a double-sided self-adhesive tape or fastener attached to the hair extension by virtue of ventilating hair through a polyurethane strip, and then a coat of polyurethane is applied so as to seal both ends of a base support unit. A removable backing is separated from the self-adhesive double-sided tape or fastener to reveal a construction thereof.

In FIG. 3 is illustrated an exploded back view to reveal components and construction of a support polyurethane base or the polyurethane strip 16, with the hair strands 18 being ventilated through the polyurethane strip by virtue of knotting each supplemental hair strand 12, implanting the supplemental hair strands 12 through the polyurethane strip 16, and applying a coat of polyurethane thus sealing attached ends of the supplemental hair strands 12 to the polyurethane strip 16. The polyurethane strip 16 is comprised of flexible and durable material that conforms to a shape and contour of various scalps and scalp surfaces in order to achieve a comfortable and unobstructed fit thereon. A fastener 14 of double-sided self-adhesive tape is rectangular and preferably narrow and elongate in order to correspond with a perimeter of the polyurethane strip 16. The fastener 14 is comprised of a self-adhesive double-sided tape 22 and a removable backing 24. The self-adhesive double-sided tape 22 is secured to the polyurethane strip 16, in order to prevent the tape 22 from being separated or repositioned during use.

Figure 4:
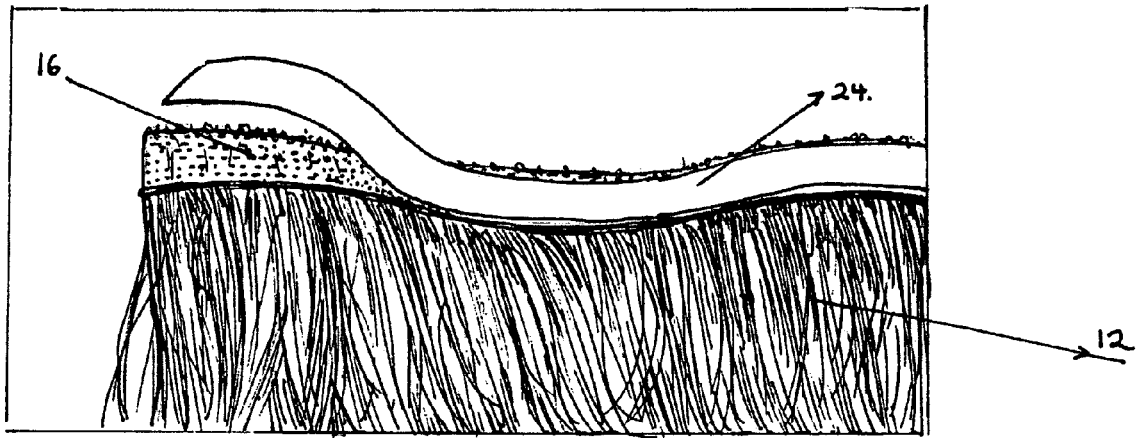
FIG. 4 is an actual view of a back side or an attachable side of the seamless hair extension with a backing attached to a fastener of self-adhesive double-sided tape.

In FIG. 4 a back view or attachable view of the seamless self-adhesive hair extension system is illustrated with the removable backing 24 attached.

Figure 5:
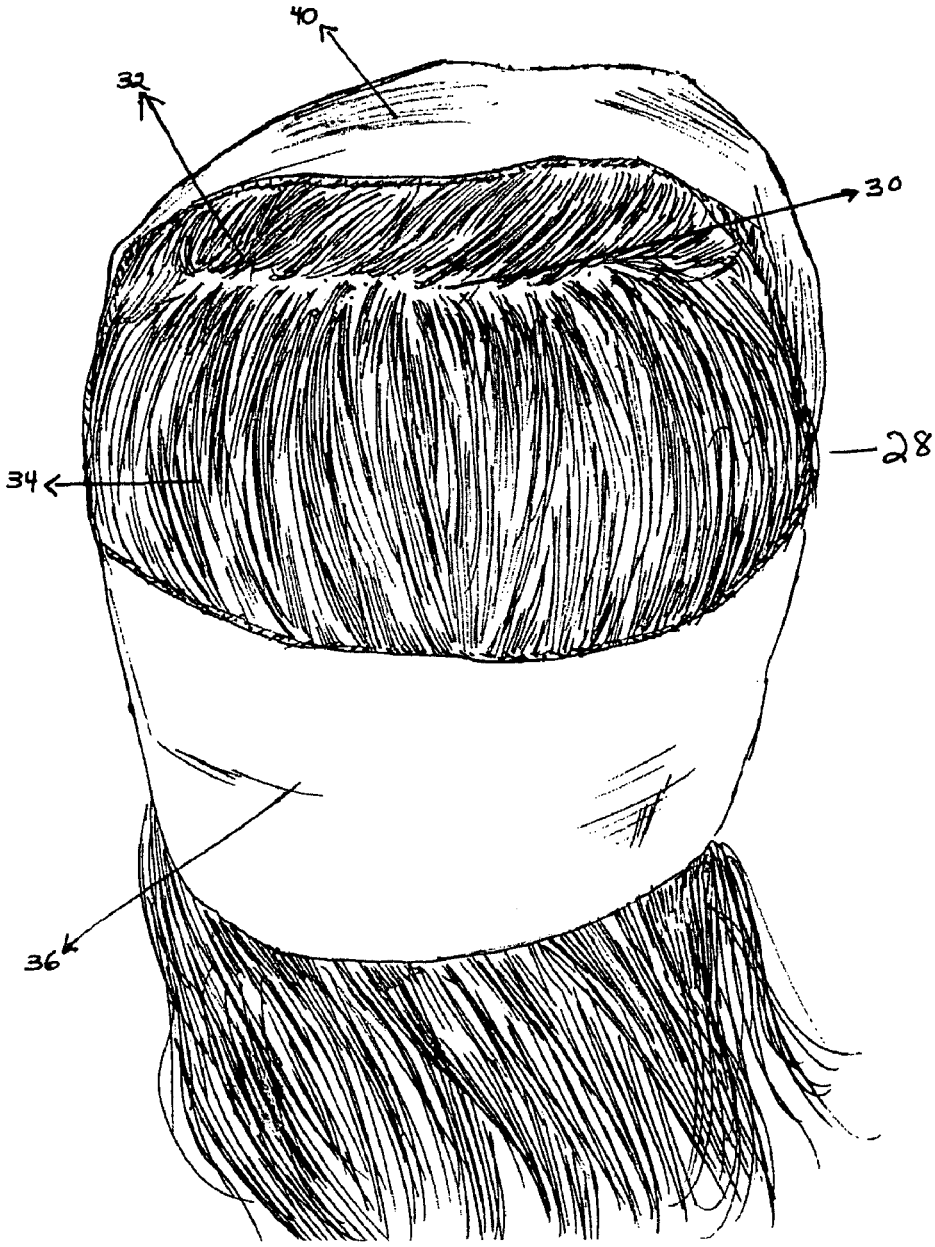
FIG. 5 is an actual view of a process and method of attachment herein referred to as step 1.

In FIG. 5 a process and method of attachment referred to as step 1 is illustrated, wherein a strip of Velcro 36 is used to secure and part an upper portion 32 and a lower portion 34, of a wearer's 28 hair, thus achieving a part line 30.

Figure 6:
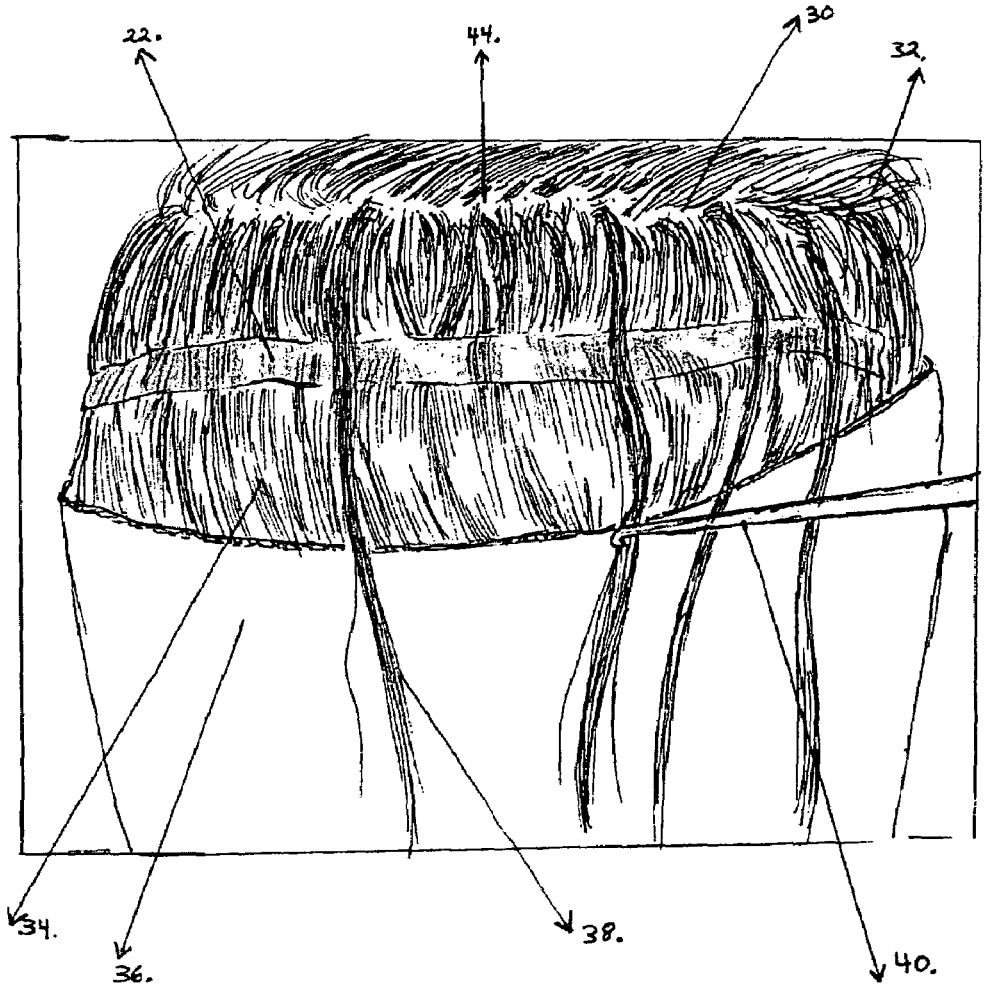
FIG. 6 is an actual view of a process and method of attachment herein referred to as step 2.

In FIG. 6 a process and method of attachment referred to as step 2 is illustrated, with the upper portion 32 and lower portion 34 being secured in an upward position by the Velcro 36, wherein a strip of double-sided self-adhesive tape 22 is placed onto the lower portion 34 of the wearer's hair 38 approximately ¼" away from the wearer's scalp 44, and by using a crotchet needle 40 the wearer's natural hair strands 38 are withdrawn in approximately ¼" alternating sections from the upper portion 32 and placed onto the double-sided self-adhesive tape 22, preferably an entire length of the self-adhesive double-sided tape 22.

Figure 7:
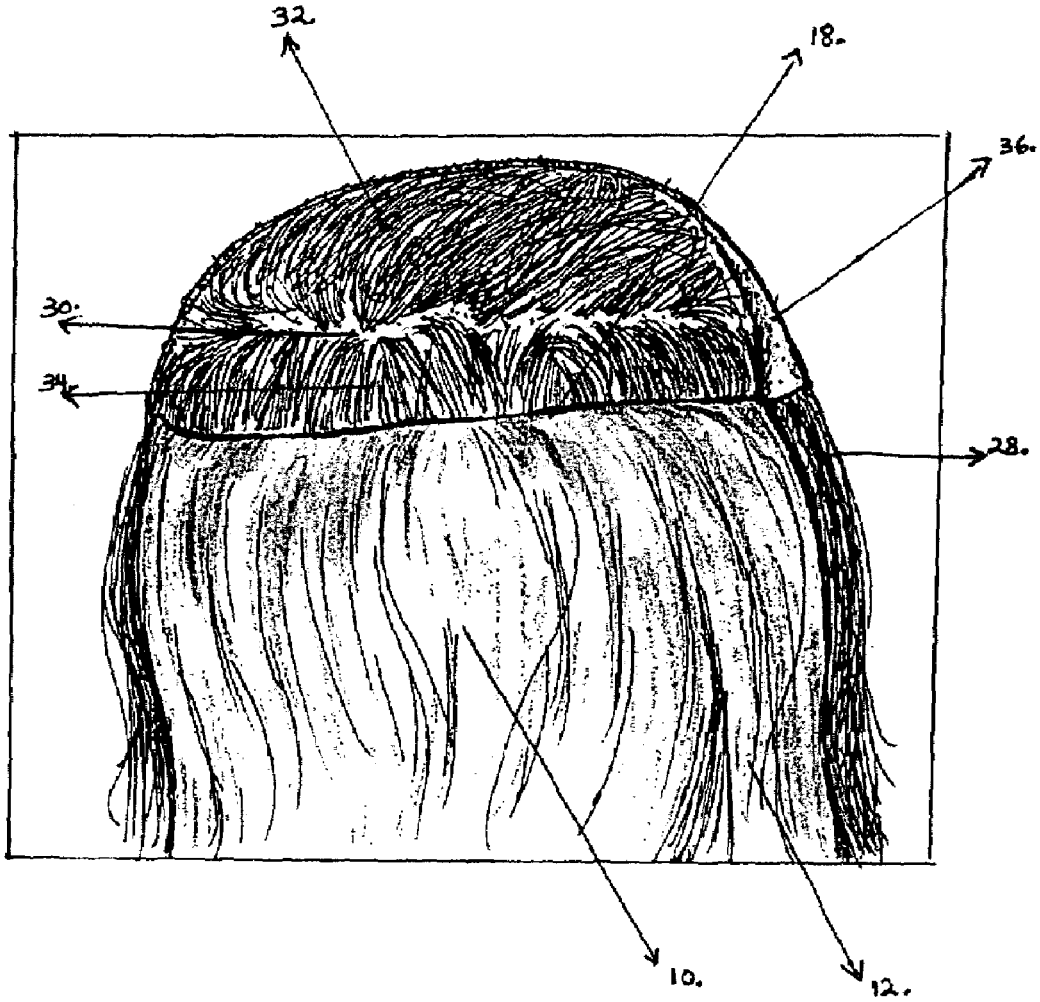
FIG. 7 is an actual view of a process and method of attachment herein referred to as step 3.

In FIG. 7 a process and method of attachment referred to as step 3 is illustrated, wherein once the wearer's natural hair strands 38 are placed onto the double-sided self-adhesive tape 22 in alternating "A" sections preferably along the entire length of the self-adhesive double-sided tape 22, as described and illustrated previously in step 2 with reference to FIG. 7, the backing 24 can be removed and the seamless hair extension 10 can be adhered to the double-sided self-adhesive tape 22 on wearer 28. If necessary, the hair extension 10 can be cut or trimmed either vertically or horizontally to conform to an existing or proposed hair style or preference of the wearer. Once the hair extension 10 is secured and aligned onto the double-sided tape 22, the upper portion 32 of the hair can be dropped by removing the Velcro strip 36, and releasing the lower portion 34 via removing the Velcro strip 36 as well. Once the hair is in its original position it will conceal the self-adhesive tape 22 as well as the polyurethane strip 16 resulting in a seamless, lifelike natural appearance of longer, thicker and or highlighted hair. Of course the hair extension 10 can be attached to the head of the wearer 28 in a variety of styles and quantities and at an assortment of locations and positions thereon, with placement only limited by imagination of the wearer and hair dresser. It should be recognized that the example of attachment described previously by no means limits the spirit and the scope of the invention, and that all possible variations of attaching the seamless self-adhesive extension 10 to either the hair or scalp of a wearer remains within the purview of the instant invention.

As the invention has been illustrated and described in detail in the illustrations and foregoing description, the same is to be considered as illustrative and not restrictive in character, it being understood that only the preferred embodiment has been shown and described and that all changes and modifications that come within the spirit of the version of the invention are desired to be protected. With respect to the above description then, it is to be realized that optimum dimensional relationships for parts of the invention, to include variations in size, materials, shape, form, function and manner of operation, assembly and use, are deemed readily apparent and obvious to one skilled in the art, and all equivalent relationships to those illustrated in the illustrations and described in the specification are intended to be encompassed by the appended claims.

CONCLUSION AND SCOPE OF INVENTION

It will be understood, from the foregoing, to persons skilled in the art, that an improved seamless self-adhesive hair extension system has been provided. The invention is relatively simple and easy to manufacture, yet affords a variety of uses. While the description contains many specifications, these should not be constructed as limitations on the scope of the invention, but rather as an exemplification of a preferred embodiment thereof. The foregoing is considered as illustrative only of principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the appended claims. Although this invention has been described in its preferred form with a certain degree of particularity, it is understood that the present disclosure of the preferred form has been made only by way of example and numerous changes in terms of construction and combination and arrangement of parts may be resorted to without departing from the spirit and scope of the invention.

I claim:

1. A method comprising:

providing a hair extension having ends of hair strands passed through a first side of a base support and secured to an opposite second side of said base support;

attaching a first side of a first double-sided self-adhesive tape to said second side of said base support;

separating hair on a head of a user into an upper portion of hair and a lower portion of hair so as to form a part line on the head of the user;

placing a first side of a second double-sided self-adhesive tape onto said lower portion of hair below said part line;

laying onto an opposite second side of said second double-sided self-adhesive tape sections of said upper portion of hair; and securing a second side of said first double-sided self-adhesive tape to said second side of said second double-sided self-adhesive tape.

2. The method according to claim 1, wherein said base support comprises a polyurethane base support.

3. The method according to claim 2, wherein said first double-sided self-adhesive tape has a removable backing on said second side thereof, and further comprising:

prior to securing said second side of said first double-sided self-adhesive tape to said second side of said second double-sided self-adhesive tape, removing said backing from said second side of said first double-sided self-adhesive tape.

4. The method according to claim 3, wherein said first double-sided self-adhesive tape comprises a rectangular-shaped, clear double-sided self-adhesive tape.

5. The method according to claim 4, further comprising:

temporarily securing said upper portion of hair and said lower portion of hair prior to placing said first side of said second double-sided self-adhesive tape onto said lower portion of hair.

6. The method according to claim 5, wherein placing said first side of said second double-sided self-adhesive tape onto said lower portion of hair comprises placing said first side of said second double-sided self-adhesive tape onto said lower portion of hair such that said second double-sided self-adhesive tape is positioned approximately ¼ inch away from a scalp of said user.

7. The method according to claim 6, wherein said second double-sided self-adhesive tape comprises a rectangular-shaped, clear double-sided self-adhesive tape.

8. The method according to claim 7, wherein laying sections of said upper portion of hair onto said second side of said second double-sided self-adhesive tape comprises laying onto said second side of said double-sided self-adhesive tape sections of said upper portion of hair that are each about ¼ inch thick so as to provide spaced rows of hair along an entire length of said second double-sided self-adhesive tape.

9. The method according to claim 8, and further comprising:

repositioning hair of said upper portion such that said hair on said head of said user generally occupies a position that said hair occupied prior to being separated into said upper portion and said lower portion.

10. The method according to claim 9, wherein securing said ends of said hair strands to said second side of said base support comprises applying a coat of polyurethane to said ends of said hair strands and said second side of said base support.

11. The method according to claim 9, wherein said hair strands comprise natural hair strands.

12. The method according to claim 9, wherein said hair strands comprise synthetic hair strands.

13. The method according to claim 9, further comprising:

wetting said first double-sided self-adhesive tape with citrus oil;

removing said first double-sided self-adhesive tape from said base support;

using cloth or paper to remove excess citrus oil from said base support; and applying another rectangular strip of double-sided self-adhesive tape onto said second side of said base support.

14. The method according to claim 9, wherein said hair extension is hypoallergenic.

15. The method according to claim 1, wherein securing said ends of said hair strands to said second side of said base support comprises applying a coat of polyurethane to said ends of said hair strands and said second side of said base support.

16. The method according to claim 1, wherein said hair strands comprise natural hair strands.

17. The method according to claim 1, wherein said hair strands comprise synthetic hair strands.

18. The method according to claim 1, further comprising:

wetting said first double-sided self-adhesive tape with citrus oil;

removing said first double-sided self-adhesive tape from said base support;

using cloth or paper to remove excess citrus oil from said base support; and applying another rectangular strip of double-sided self-adhesive tape onto said second side of said base support.

19. The method according to claim 1, wherein said hair extension is hypoallergenic.

20. The method according to claim 1, wherein said first double-sided self-adhesive tape has a removable backing on said second side thereof, and further comprising:

prior to securing said second side of said first double-sided self-adhesive tape to said second side of said second double-sided self-adhesive tape, removing said backing from said second side of said first double-sided self-adhesive tape.

* * * * *